US008275156B2

(12) United States Patent
Akino

(10) Patent No.: US 8,275,156 B2
(45) Date of Patent: Sep. 25, 2012

(54) RIBBON MICROPHONE AND RIBBON MICROPHONE UNIT

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 693 days.

(21) Appl. No.: 12/265,477

(22) Filed: Nov. 5, 2008

(65) Prior Publication Data

US 2009/0116670 A1 May 7, 2009

(30) Foreign Application Priority Data

Nov. 6, 2007 (JP) ..... 2007-288199

(51) Int. Cl.
*H04R 25/00* (2006.01)

(52) U.S. Cl. ..... 381/176

(58) Field of Classification Search ..... 381/176, 381/399

See application file for complete search history.

(56) References Cited

U.S. PATENT DOCUMENTS

| | | | | | |
|---|---|---|---|---|---|
| 2,064,316 | A | * | 12/1936 | Olson et al. | 381/427 |
| 2,130,946 | A | * | 9/1938 | Brune | 381/174 |
| 2,346,395 | A | * | 4/1944 | Rettinger | 381/162 |
| 2,963,557 | A | * | 12/1960 | Anderson | 381/176 |
| 4,461,932 | A | * | 7/1984 | Oyaba | 381/117 |
| 6,104,825 | A | * | 8/2000 | Thigpen | 381/408 |
| 7,894,619 | B2 | * | 2/2011 | Crowley | 381/176 |
| 2006/0078135 | A1 | * | 4/2006 | Royer et al. | 381/176 |

FOREIGN PATENT DOCUMENTS

| | | | | |
|---|---|---|---|---|
| JP | 31-15703 | U | | 9/1956 |
| JP | 57-119989 | U | | 7/1982 |
| JP | 57-163892 | U | | 10/1982 |
| JP | 57-171900 | A | | 10/1982 |
| JP | 58-011397 | U | | 1/1983 |
| JP | 2001333492 | A | * | 11/2001 |
| JP | 2005-252440 | A | | 9/2005 |
| JP | 2005-260561 | A | | 9/2005 |
| JP | 2006-067136 | A | | 3/2006 |
| JP | 2006-253859 | A | | 9/2006 |
| JP | 2006-319595 | A | | 11/2006 |
| JP | 2008-042622 | A | | 2/2008 |
| JP | 2008-199336 | A | | 8/2008 |

OTHER PUBLICATIONS

Machine translation of JP-2001-333492A, Nov. 30, 2001.*
Harry F. Olson, "A History of High-Quality Studio Microphones", Journal of the Audio Engineering Society, v. 24, issue 10, Dec. 1976, pp. 219-228.

(Continued)

*Primary Examiner* — Lex Malsawma
(74) *Attorney, Agent, or Firm* — Sughrue Mion, PLLC

(57) ABSTRACT

To obtain a ribbon microphone unit, which makes the tension of a diaphragm adjustable by configuring a ribbon diaphragm assembly that is detachable to a magnetic-circuit assembly including a magnet, and which further allows a user side to carry out the maintenance by replacing the ribbon diaphragm assembly; a ribbon microphone unit comprises: a magnetic-circuit assembly including a magnet; and a ribbon diaphragm, wherein the ribbon diaphragm, together with a substrate having a circuit pattern formed on both ends thereof, a metal fitting for crimping an end portion of the ribbon diaphragm to the circuit pattern, and a screw for crimping the metal fitting toward the substrate, constitute a diaphragm assembly, and wherein the diaphragm assembly is secured to the magnetic-circuit assembly.

14 Claims, 12 Drawing Sheets

OTHER PUBLICATIONS

Harry F. Olson, "Microphones for Recording", Journal of the Audio Engineering Society, v. 25, issue 10/11, Nov. 1977, pp. 229-237.
Harry F. Olson, "Ribbon Velocity Microphones", Journal of the Audio Engineering Society, v. 18, issue 3, Jun. 1970, pp. 202-207.
Office Action in Japanese Application No. 2007-288199 issued on Mar. 6, 2012.

* cited by examiner

RIBBON MICROPHONE AND RIBBON MICROPHONE UNIT

BACKGROUND OF THE INVENTION

1. Field of the Invention

The present invention relates to ribbon microphones and ribbon microphone units.

2. Related Background of the Invention

A ribbon microphone includes a magnet for forming a magnetic field and a ribbon diaphragm, as main component members. The magnet is disposed on both sides of the ribbon diaphragm to sandwich the same, whereby a magnetic field is formed between the magnets on the both sides. The ribbon diaphragm is given an appropriate tension and disposed within the magnetic field while the both longitudinal ends are held down. In response to a sound wave, the ribbon diaphragm vibrates within the magnetic field and thereby a current corresponding to the sound wave flows through the ribbon diaphragm and thus the sound wave is converted into an electric signal. Generally, an aluminum foil is used as the material of the ribbon diaphragm. Since aluminum has an excellent electrical conductivity as compared with other metallic materials and also has a low specific gravity, aluminum is suitable as the ribbon diaphragm of the ribbon microphone.

The ribbon microphone is a mass control type microphone, and in the reproduction limit of the low frequency side, the lower the resonance frequency of the ribbon diaphragm, to the lower frequency the sound signal can be electroacoustically transduced. However, if the resonance frequency of the ribbon diaphragm is too low, such a problem will occur that the ribbon diaphragm easily moves to contact a pole for forming the magnetic field when a wind blows against the ribbon diaphragm or when a vibration is applied thereto. For this reason, in order to attach the ribbon diaphragm, it is necessary to pull the both longitudinal ends with an appropriate force, fix the both ends under an appropriate tension, and increase the resonance frequency to an appropriate frequency.

Then, in the manufacture process of the conventional ribbon microphone or in the adjustment process thereof, an operator lightly blows on the ribbon diaphragm, and visually observes and checks the bending level of the ribbon diaphragm at that time, and then adjusts the tension to an appropriate one. As described above, an aluminum foil is suitable for the ribbon diaphragm of the ribbon microphone. However, since the aluminum foil is extremely thin and light weighted, it may break when provided in a tensioned state while the tension is adjusted. Accordingly, good or poor results of the product largely depend on the skills of an operator, so a lot of skills are required in order to manufacture an excellent ribbon microphone.

Although the present invention relates to the ribbon microphone, the structure is similar to the structure of a ribbon speaker. In the ribbon speaker, a signal current is passed through a ribbon diaphragm, and then cooperating with a magnetic field which a magnet generates, the ribbon diaphragm is vibrated to generate sounds. Hereinafter, the inventions described in Patent Documents related to the present invention, including the ribbon speaker, will be described.

The invention described in Patent Document 1 relates to a tension adjustment method of a ribbon diaphragm of a ribbon microphone. This conventional ribbon microphone unit comprises a yoke formed into a square frame, and a ribbon diaphragm disposed along the longitudinal direction of the yoke and in the center portion in the width direction of this yoke. The yoke integrally includes a support plate near the both longitudinal ends, and a presser plate is disposed on the lower surface side of these support plates, respectively. The presser plate is secured to the support plates by fastening a screw, respectively. This screw is adjusted so as to lightly press the ribbon diaphragm in advance, and then the ribbon diaphragm is vibrated by a vibrator, and while observing its amplitude, the tension of the ribbon diaphragm is adjusted, and then by fastening the screw the ribbon diaphragm is secured. Since the screw is used as a securing unit of the ribbon diaphragm, the tension adjustment of the ribbon diaphragm can be carried out repeatedly.

The invention described in Patent Document 2 relates to a method of assembling a diaphragm assembly including a ribbon diaphragm used for a ribbon speaker. This conventional example comprises: a ribbon diaphragm that is wound in a roll form; a magazine component in which a slit is formed in the longitudinal direction and an adhesive layer is formed in the surface thereof; and a pressure roller wider than the slit. The above-described magazine component is made up of a nonmagnetic aluminum material, and the ribbon diaphragm is disposed parallel to the longitudinal direction of the slit. In the method of assembling the diaphragm assembly, while moving the magazine component in the longitudinal direction, the ribbon diaphragm is continuously pressure-welded to the magazine component via the adhesive layer by the pressure welding of a pressure roller, and thereby the both longitudinal ends of the ribbon diaphragm are bonded to the magazine component. According to the method of assembling the diaphragm assembly, which is a conventional example, the failure rate of the ribbon diaphragms caused by a manual assembly can be reduced, and the diaphragm assembly can be manufactured automatically and continuously.

The invention described in Patent Document 3 relates to a ribbon speaker. This conventional example comprises: a yoke, wherein a magnetic gap-forming portion of the yoke that constitutes a magnetic circuit together with a magnet is divided; and a vibration-system assembly provided with a ribbon diaphragm. The vibration-system assembly functions as a spacer, which prevents the divided yokes from contacting to each other by interposing a nonmagnetic material, e.g., an aluminum material, between the divided yokes. Moreover, by interposing the vibration-system assembly within the parallel magnetic field generated between the divided yokes, excellent frequency characteristics can be obtained. A signal current is passed through the diaphragm provided in the vibration-system assembly to vibrate the diaphragm, thereby outputting a sound. The vibration-system assembly can be detached by disassembling each of the divided yokes. Accordingly, when the diaphragm is damaged, the repair of the damage or the component replacement can be easily carried out by detaching the vibration-system assembly.

The invention described in Patent Document 4 relates to a ribbon speaker. Both ends in the axial length direction of a ribbon diaphragm are supported with a stationary terminal, and at the same time an ultraviolet curing resin is applied to the edge in the axial length direction and to the wall surface of a plate disposed within a magnetic gap, in which the ribbon diaphragm is disposed. Then, the ultraviolet curing resin is irradiated with an ultraviolet ray and is reacted, and thereby the diaphragm is attached to the inside of the magnetic gap of the magnetic circuit. The air-setting adhesive has a drawback that a long curing time and also an unstable cured state due to the variation in the curing conditions affect the performance of the ribbon diaphragm. In contrast, in the ultraviolet curing resin, a portion coated with the ultraviolet curing resin is irradiated with an ultraviolet ray, thereby eliminating a nonuniformity or variation in the cured state or curing time and thus obtaining a stable cured state.

[Patent Document 1] Japanese Unexamined Patent Application Publication No. 2006-319595

[Patent Document 2] Japanese Unexamined Patent Application Publication No. S57-171900

[Patent Document 3] Japanese Unexamined Utility Model Application Publication No. S57-163892

[Patent Document 4] Japanese Unexamined Utility Model Application Publication No. S57-119989

SUMMARY OF THE INVENTION

Problems to be Solved by the Invention

The ribbon diaphragm of the ribbon microphone is likely to be loosened by being blown by a strong wind or by an application of an impact, and if the loosened amount becomes above a certain level, it is necessary to readjust the tension and furthermore replace the ribbon diaphragm. According to the invention described in Patent Document 1, the use of a screw as the securing unit of the ribbon diaphragm allows for the readjustment of the tension of the ribbon diaphragm. However, according to the conventional ribbon microphones including that of the invention described in Patent Document 1, the ribbon diaphragm is secured directly to the magnetic-circuit assembly to constitute the microphone unit, and therefore there is a drawback that only those of skill in the ribbon microphone can maintain the ribbon microphone. Accordingly, when the adjustment or replacement of the ribbon diaphragm is required, the whole microphone needs to be sent to the manufacturer.

In the inventions described in Patent Documents 2 to 4, as the method of adhering the ribbon diaphragm to the magazine component or the plate, an adhesive, thermocompression bonding, or bonding by an ultraviolet curing resin is used. These inventions relate to the diaphragm of the ribbon speaker, and even if these inventions are applied to a diaphragm made up of a very thin material, such as aluminum foil, as in the present invention in this application, it is impossible to cause the resultant diaphragm to function as a diaphragm that vibrates in response to a sound wave. Even if referring to the configuration of the conventional ribbon speaker and this configuration is applied to the diaphragm of a ribbon microphone, the ribbon diaphragm is difficult to be detached once bonded to a plate or the like. For example, in a diaphragm bonded using an air-setting adhesive or the like, the diaphragm needs to be detached by heat treating the adhesion portion again and the diaphragm itself may be damaged depending on the circumstances. Furthermore, in the ribbon speaker, once the diaphragm is incorporated, the tension needs not be readjusted, and therefore there is not even a concept of replacing the ribbon diaphragm.

In view of the prior arts described above, the present invention has employed a concept of configuring a ribbon diaphragm assembly that is detachable to a magnetic-circuit assembly, and an object of the present invention is to provide a ribbon microphone and a ribbon microphone unit which make it possible to detach the ribbon diaphragm assembly from the magnetic-circuit assembly and then adjust the tension of the diaphragm, and which further allows a user side to carry out the maintenance of the ribbon diaphragm by replacing the ribbon diaphragm assembly.

Means for Solving the Problems

According to a main feature of the present invention, a ribbon microphone unit comprises: a magnetic-circuit assembly including a magnet and having a magnetic gap; and a ribbon diaphragm that is disposed inside the magnetic gap and vibrates in response to a sound wave, wherein the magnetic-circuit assembly comprises: a yoke having a window hole; and a magnet secured to a wall surface of the window hole, wherein the ribbon diaphragm, together with a substrate having a window hole and having a circuit pattern formed on both ends of the window hole, a metal fitting for crimping an end portion of the ribbon diaphragm to the circuit pattern, and a screw for crimping the metal fitting toward the substrate, constitute the ribbon diaphragm assembly, and wherein the ribbon diaphragm assembly is secured to the magnetic-circuit assembly.

Advantages of the Invention

The ribbon microphone unit according to the present invention comprises the magnetic-circuit assembly and the ribbon diaphragm assembly (hereinafter, referred to as the "diaphragm assembly"), and each of them is detachable. This structure allows a user side to detach the diaphragm assembly from the magnetic-circuit assembly and carry out the maintenance, such as the tension adjustment, replacement, and the like of the ribbon diaphragm. In particular, the replacement of the diaphragm assembly can be easily carried out by detaching the diaphragm assembly from the magnetic-circuit constituting portion and then by attaching a new diaphragm assembly, and therefore the magnetic-circuit assembly needs not be replaced. Moreover, the replacement of the magnetic-circuit assembly can be easily carried out by detaching the diaphragm assembly from the magnetic-circuit assembly. Furthermore, the maintenance of only the ribbon diaphragm is also possible, and by loosening a screw securing the ribbon diaphragm via the metal fitting, the tension adjustment or the detachment of the ribbon diaphragm is possible.

Moreover, in the ribbon microphone unit according to the present invention, a dustproof cloth or a magnet may be attached to the window hole of the diaphragm assembly. This structure can prevent the occurrence of a problem by preventing the penetration of a minute iron powder or foreign substance, which is to enter the inside of the microphone unit from the outside of the ribbon microphone, by means of the dustproof cloth, or by adhering the minute iron powder or foreign substance to the magnet.

DESCRIPTION OF THE PREFERRED EMBODIMENTS

Figure 1A:
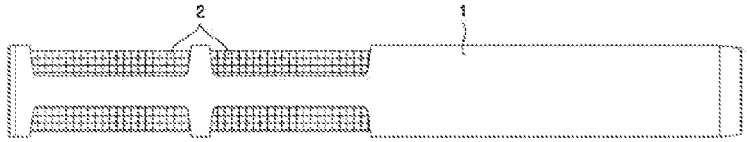
FIG. 1 shows an embodiment of a ribbon microphone according to the present invention, wherein FIG. 1(*a*) is a schematic plane view, and FIG. 1(*b*) is a schematic front view.
Figure 1B:
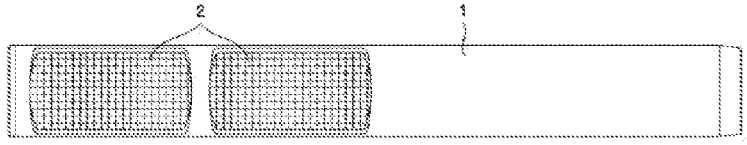
Figure 2A:
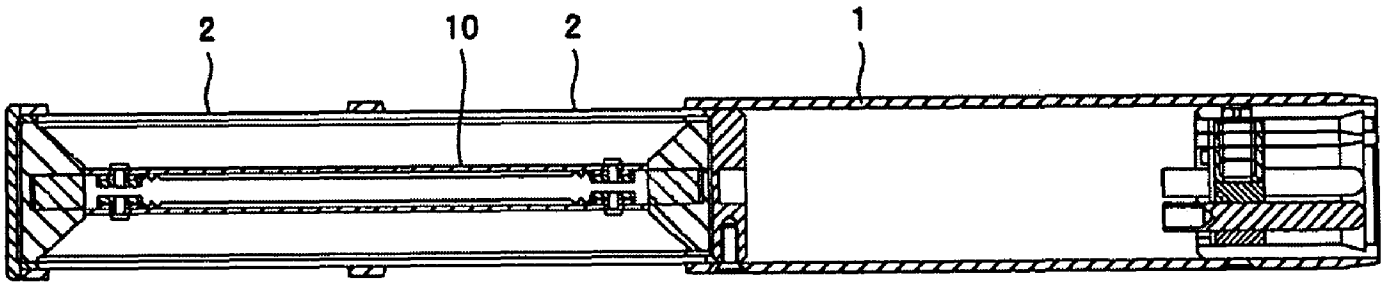
FIG. 2 shows the ribbon microphone according to the embodiment, wherein FIG. 2(*a*) is a plane cross sectional view, FIG. 2(*b*) is a front cross sectional view, and FIG. 2(*c*) is a side cross sectional view.
Figure 2B:
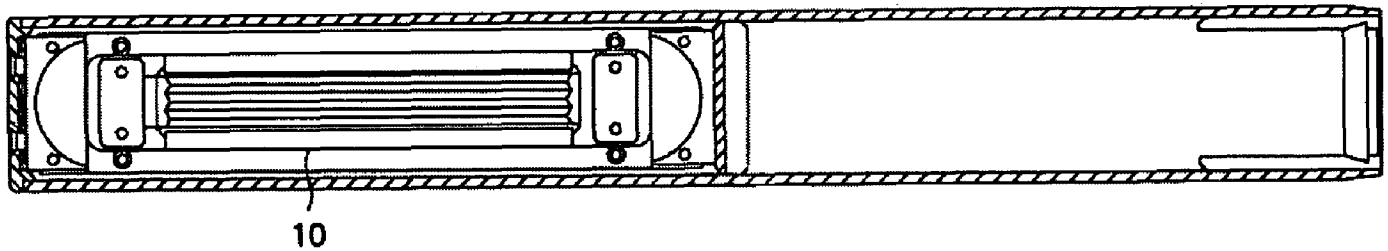
Figure 2C:
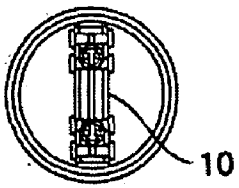

Hereinafter, the embodiments of a ribbon microphone and a ribbon microphone unit according to the present invention will be described with reference to the accompanying drawings. In FIG. 1, reference numeral 1 denotes a microphone case. The microphone case 1 is cylindrical, and in the wall surface thereof, on the positions having a mutually front-rear relation, from the center portion to the tip portion, two rectangular window holes that are long in the longitudinal direction are formed side by side in the longitudinal direction of the microphone case 1, respectively. A mesh 2 is stuck to these window holes. Sounds from the outside of the microphone case 1 pass through the mesh 2, and reach a microphone unit disposed inside the microphone case 1. In FIG. 2, reference numeral 10 denotes the microphone unit. The microphone unit 10 is installed in the center position inside the microphone case 1 and corresponding to the attached position of the mesh 2.

Figure 3A:
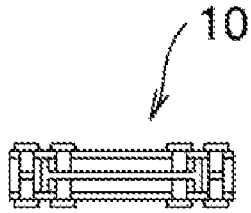
FIG. 3 shows a microphone unit in the embodiment, wherein FIG. 3(*a*) is a cross sectional view when viewed from the front, FIG. 3(*b*) is a plane view, and FIG. 3(*c*) is a cross sectional view when viewed from the side.
Figure 3B:
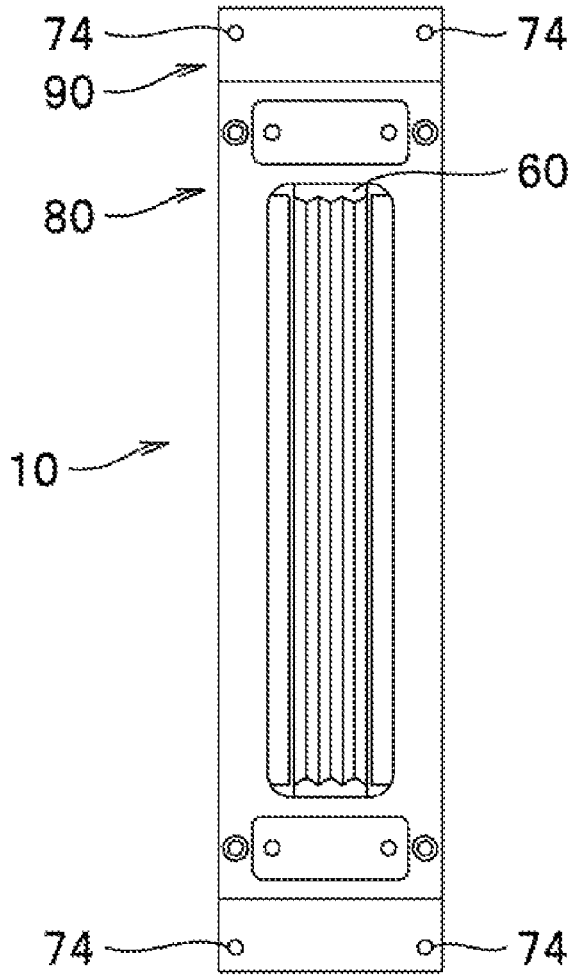
Figure 3C:
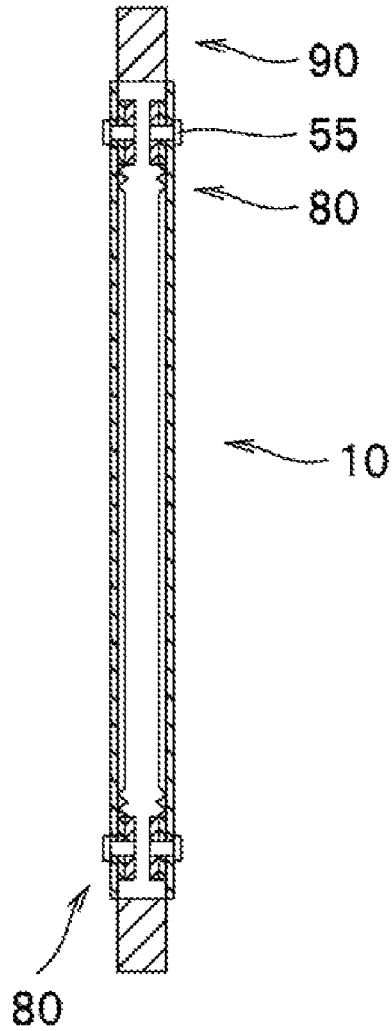
Figure 5A:
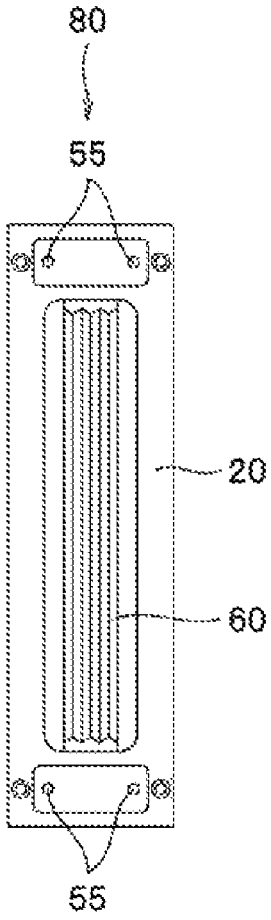
FIG. 5 shows a diaphragm assembly in the embodiment, wherein FIG. 5(*a*) is a plane view, FIG. 5(*b*) is a cross sectional view when viewed from the side, and FIG. 5(*c*) is a bottom view.
Figure 5B:
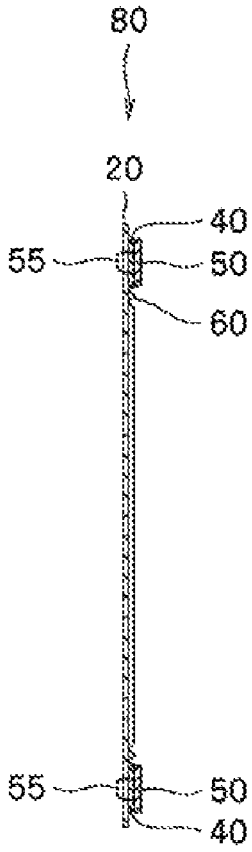
Figure 5C:
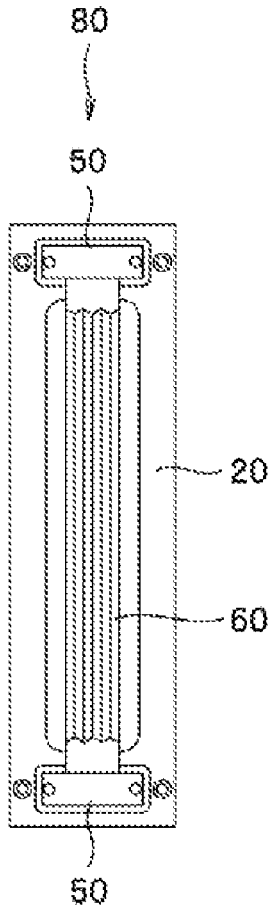
Figure 7A:
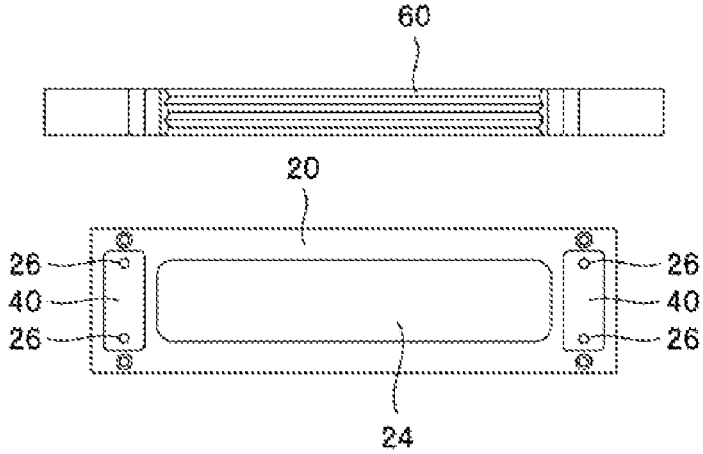
FIG. 7 shows the diaphragm assembly in the embodiment, wherein FIG. 7(*a*) is an exploded plane view, and FIG. 7(*b*) is a plane view.
Figure 7B:
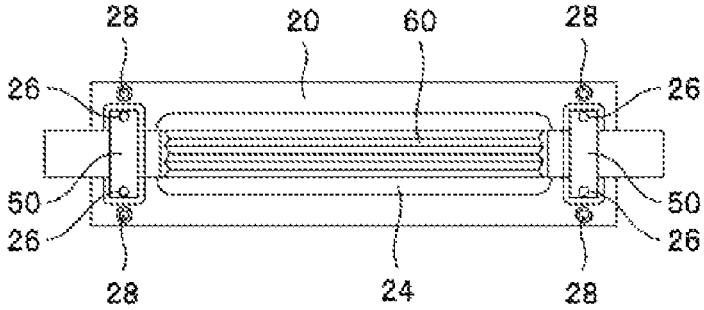

As shown in FIGS. 3(*a*), (*b*), and (*c*), the microphone unit 10 comprises a diaphragm assembly denoted by reference numeral 80, and a magnetic-circuit assembly denoted by reference numeral 90. The diaphragm assembly 80 comprises a substrate 20, a spacer 40, a ribbon diaphragm 60, a metal fitting 50, and a screw 55, as shown in FIG. 5 and FIG. 7. The substrate 20 is rectangular, and in the center thereof a rectangular window hole 24 that is long in the longitudinal direction is formed. The ribbon diaphragm 60 is disposed vertically across the window hole 24. The width of the ribbon diaphragm 60 is smaller than the width of the window hole 24. Near the both longitudinal ends of the substrate 20, a rectangular circuit pattern 22 that is long in the width direction of the substrate 20 is formed. The both longitudinal ends of the ribbon diaphragm 60 span the circuit pattern 22, and are secured by a securing unit comprising the spacer 40, the metal fitting 50, and the screw 55. This securing unit will be described later.

Figure 8A:
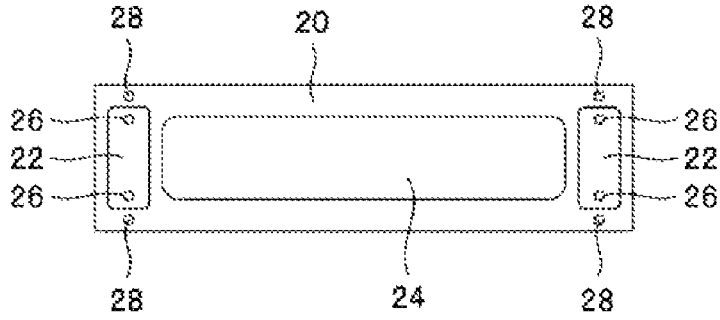
FIG. 8 shows a substrate in the embodiment, wherein FIG. 8(*a*) is a plane view, and FIG. 8(*b*) is a bottom view.
Figure 8B:
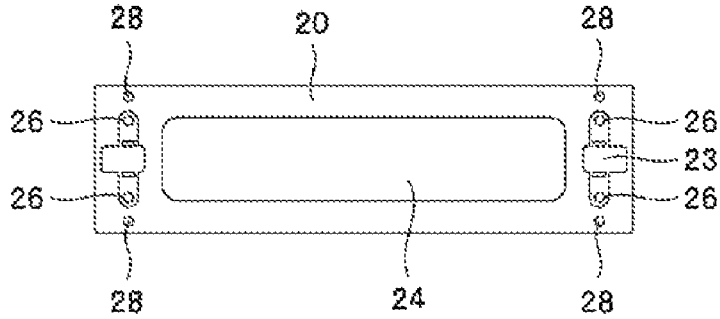

In FIG. 8, at four corners on the plane of the substrate 20, in order to secure the diaphragm assembly 80 to the magnetic-circuit assembly 90 by using a screw, there is formed a hole 28 for passing the screw therethrough. The diaphragm assembly 80 is installed in the state that the side in which the ribbon diaphragm 60 is provided in a tensioned state faces the yoke 70. As shown in FIG. 5(*b*), in the diaphragm assembly 80 when viewed from the side, the metal fitting 50, the ribbon diaphragm 60, and the spacer 40 project from the surface of the substrate 20, and these members are fitted in the window hole 72 of the yoke 70. The ribbon diaphragm 60 provided in a tensioned state in the diaphragm assembly 80 is positioned within a magnetic gap of the parallel magnetic flux formed by two magnets 30 that are fixedly adhered to the magnetic-circuit assembly 80. As shown in FIGS. 8(*a*), (*b*), in the substrate 20, the circuit pattern 23 is formed also on the opposite side of the surface on which the circuit pattern 22 is formed. The circuit pattern 23 is cruciform, and the hole 26 passing through the circuit pattern 22 passes through the circuit pattern 23, and a connection portion of an electrode is positioned in the circuit pattern 23. The connection portion of the electrode is connected to an external circuit.

Figure 10A:
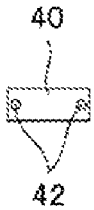
FIG. 10(*a*) shows a spacer in the embodiment, wherein FIG. 10(*a*) is a plane view, and FIG. 10(*b*) is a side view.
Figure 10B:
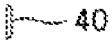
Figure 11A:
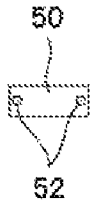
FIG. 11(*a*) shows a metal fitting in the embodiment, wherein FIG. 11(*a*) is a plane view, and FIG. 11(*b*) is a side view.
Figure 11B:
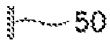
Figure 12A:
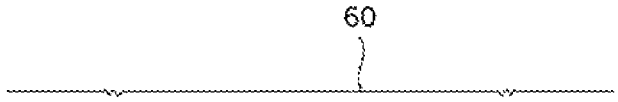
FIG. 12 shows a ribbon diaphragm in the embodiment, wherein FIG. 12(*a*) is a front view, FIG. 12(*b*) is a plane view, and FIG. 12(*c*) is a side view.
Figure 12B:
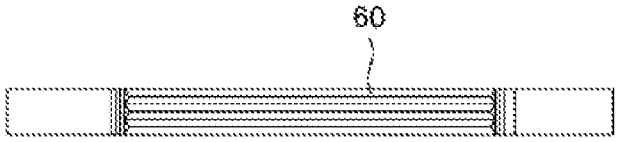
Figure 12C:
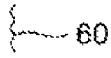

FIG. 10 shows the spacer. The spacer 40 is made up of an electrically conductive material, and is rectangular, and a hole 42 for passing a screw therethrough is formed on the both ends. The metal fitting 50 shown in FIG. 11 is made up of an electrically conductive material, and is rectangular, and a hole 52 for passing a screw therethrough is formed on the both ends. The thickness of the metal fitting 50 is slightly thicker than the thickness of the spacer 40.

Figure 6A:
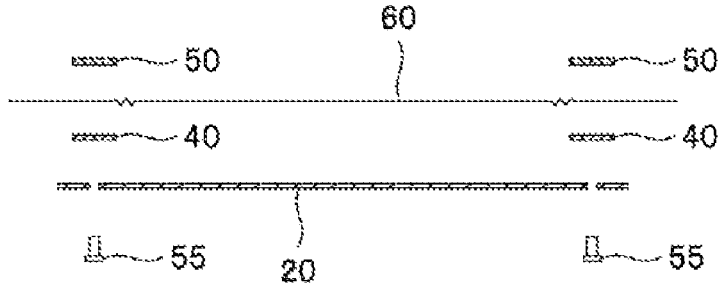
FIG. 6 shows the diaphragm assembly in the embodiment, wherein FIG. 6(*a*) is an exploded cross sectional view when viewed from the side, and FIG. 6(*b*) is an exploded cross sectional view when viewed from the side.
Figure 6B:
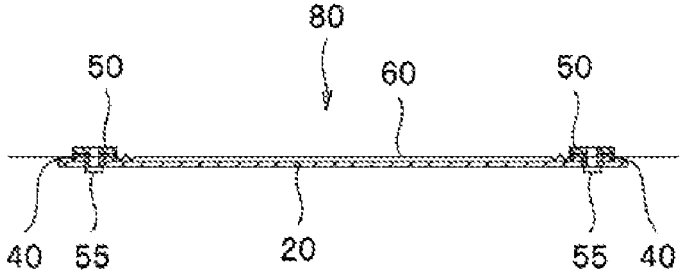

The securing unit of the ribbon diaphragm 60 is described with reference to FIG. 6 and FIG. 7. In the substrate 20, at the both longitudinal ends of the circuit pattern 22, the hole 26 is formed passing through the circuit pattern 22. A screw 55 is inserted into these holes 26 from the under side in FIG. 6. The spacer 40 is disposed on the upper surface of the circuit pattern 22, and the ribbon diaphragm 60 is disposed on the upper surface of the spacer 40, and furthermore on the upper surface thereof the metal fitting 50 is disposed. The screw 55 is inserted into the hole 42 of the spacer 40 from the under side toward the upper side. The screw 55 is fastened into the screw hole 52 of the metal fitting 50, whereby the ribbon diaphragm 60 and the spacer 40 are crimped and secured between the screw 55 and the metal fitting 50.

Figure 4A:
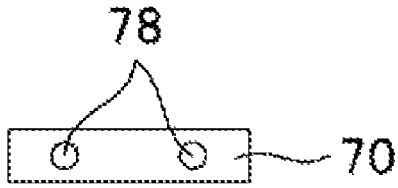
FIG. 4 shows a magnetic-circuit assembly in the embodiment, wherein FIG. 4(*a*) is a front view, FIG. 4(*b*) is a plane view, and FIG. 4(*c*) is a cross sectional view when viewed from the side.
Figure 4B:
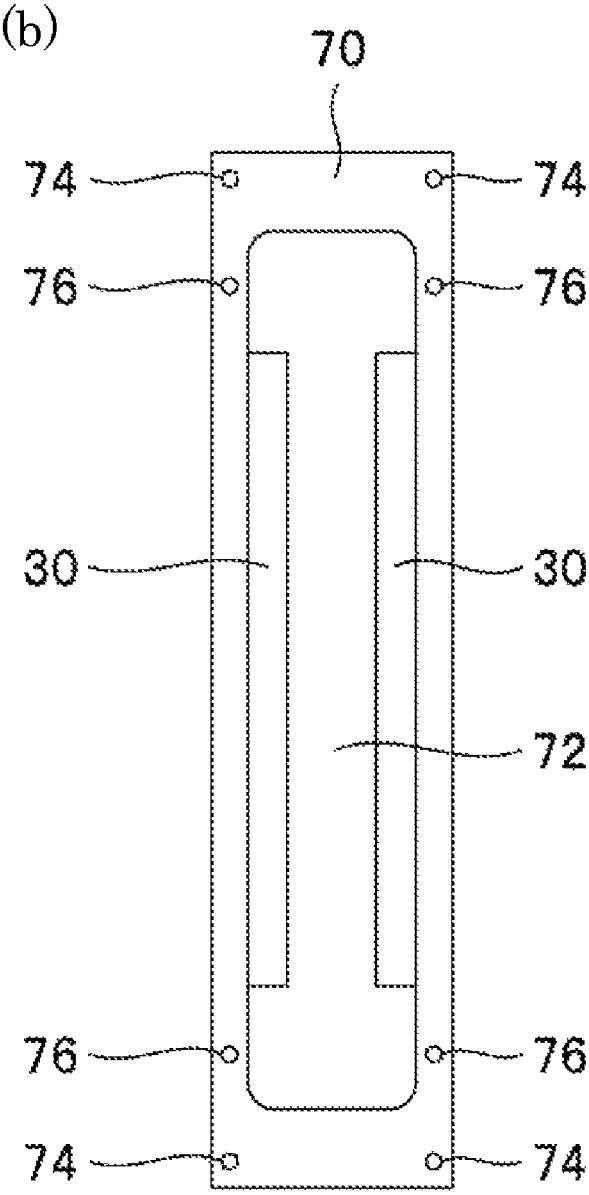
Figure 4C:
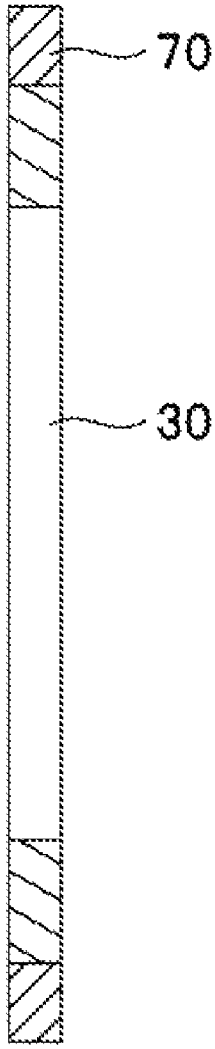
Figure 9A:
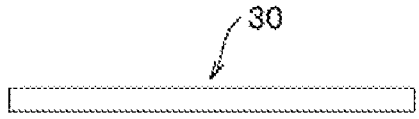
FIG. 9 shows a magnet in the embodiment, wherein FIG. 9(*a*) is a plane view, and FIG. 9(*b*) is a front view.
Figure 9B:
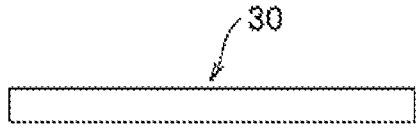

Next, a specific configuration of the magnetic-circuit assembly 90 is described. As shown in FIG. 4, the magnetic-circuit assembly 90 comprises the yoke 70 and the magnet 30. The yoke 70 is rectangular and has an appropriate thickness, wherein a rectangular window hole 72 that is long in the longitudinal direction is formed in the center, and the magnet 30 is fixedly adhered to the inner-wall surfaces, which are parallel to the longitudinal direction of the window hole 72 and face to each other, respectively. As shown in FIG. 9, the magnet 30 forms a slender rectangular column shape, and is magnetized in the width direction. A gap is formed between the opposing magnets 30. The opposed face of each magnet 30 is disposed so as to have a different pole. The yoke 70 and a pair of magnets 30 constitute the magnetic circuit, and the gap between the magnets 30 forms the magnetic gap for the parallel magnetic flux. The magnet 30 is made up of a neodymium material, and generates a relatively strong magnetic force.

Figure 13A:
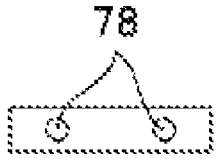
FIG. 13 shows a yoke in the embodiment, wherein FIG. 13(*a*) is a front view, FIG. 13(*b*) is a plane view, and FIG. 13(*c*) is a cross sectional view when viewed from the side.
Figure 13B:
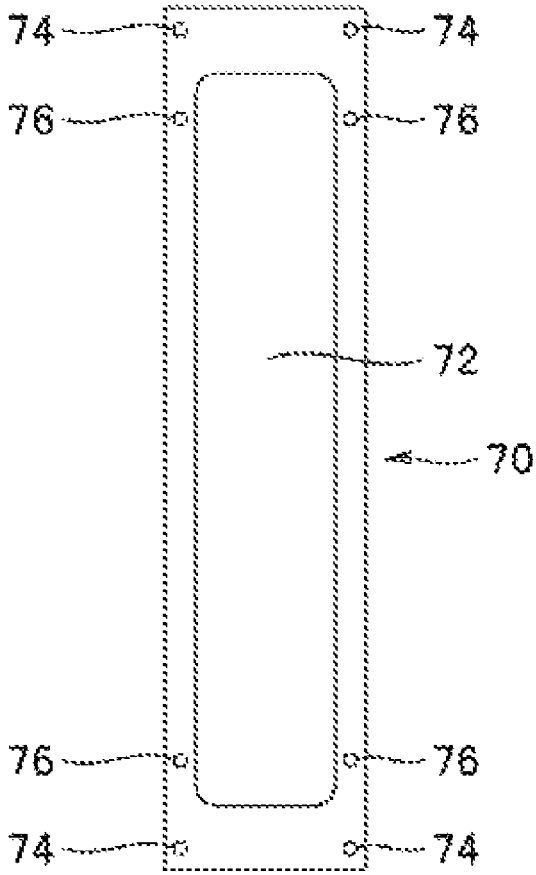
Figure 13C:
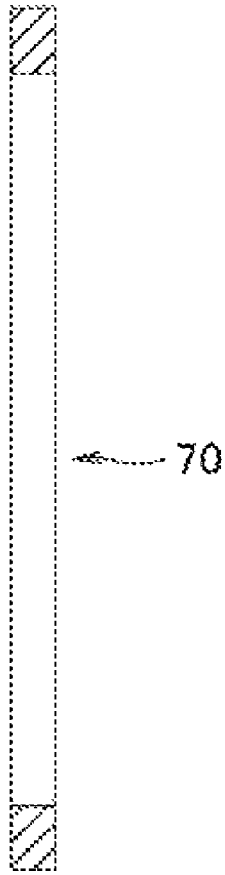

In FIG. 4(*b*), a screw hole 74 is formed at four corners of the plane of the yoke 70, respectively. Moreover, at the both longitudinal ends of the window hole 72 as well as at both width-directional ends of the yoke 70, a screw hole 76 is formed at four places, respectively. As shown in FIG. 13(*a*), on the front of the yoke 70, a screw hole 78 is formed near both longitudinal ends. The screw hole 74 and the screw hole 78 are for securing the yoke 70 to the microphone case, and the screw hole 76 is for securing the later-described diaphragm assembly 80.

In the embodiment of the microphone unit 10 shown in FIG. 3, two diaphragm assemblies 80 are used with respect to one magnetic-circuit assembly 90. Two diaphragm assemblies 80 sandwich the magnetic-circuit assembly 90 from both sides, with the rear surfaces facing to each other. The yoke 70 constituting the magnetic-circuit assembly 90 is rectangular and has an appropriate thickness, as described above. The magnetic-circuit assembly 90 and the diaphragm assembly 80 have approximately the same dimension in the width direction, and the longitudinal dimension of the magnetic-circuit assembly 90 is longer than that of the diaphragm assembly 80. The magnetic-circuit assembly 90 is secured to the microphone case 1 using the later-described fixing method.

The maintenance method of the ribbon diaphragm 60 is described. The diaphragm assembly 80 is detached from the microphone unit 10, and then the screw 55 is loosened to detach the ribbon diaphragm 60. The ribbon diaphragm to be replaced is prepared so as to be slightly longer than the length to be normally used. In the substrate 20, the spacer 40 is disposed on the circuit pattern 22, and the screw 55 is passed through the hole 26 of the circuit pattern and the hole 42 of the spacer 40 from the lower side of the substrate 20. The ribbon diaphragm 60 is vertically across the window hole 24 along the longitudinal axis line of the substrate 20, and is disposed on the upper surface of each spacer 40 at both longitudinal ends of the substrate 20. The metal fitting 50 is loosely fastened from above the ribbon diaphragm 60, and the tension is adjusted while pulling the remainder portion of the ribbon diaphragm 60 that extends from each spacer 40 to the horizontal direction, and then the metal fitting 50 is fastened and the remainder portion of the ribbon diaphragm 60 is cut off. Again, the diaphragm assembly 80 is attached to the magnetic-circuit assembly 90. Moreover, if the replacement of the diaphragm assembly 80 itself is required, it is possible to detach the diaphragm assembly 80 from the microphone unit 10 and replace the whole diaphragm assembly 80.

Figure 14:
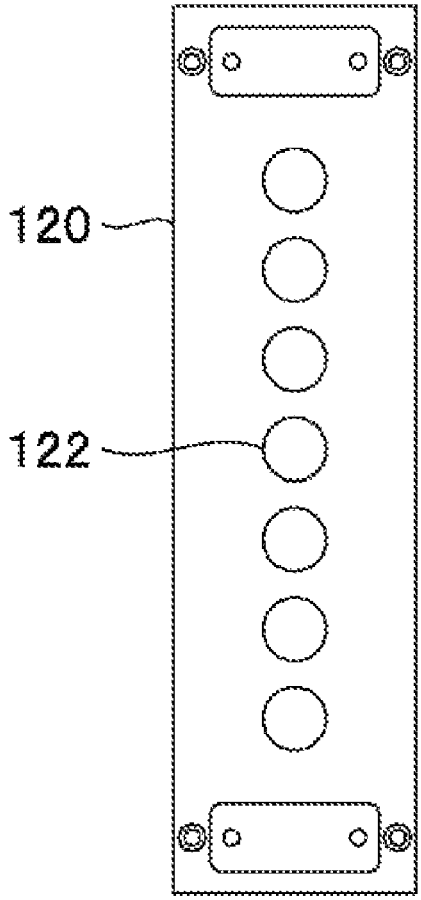
FIG. 14 is a plane view showing a modification of the diaphragm assembly applicable to the present invention.

FIG. 14 shows a modification of the substrate constituting the diaphragm assembly. In FIG. 14, in a substrate 120, there are formed a plurality of circular holes 122 along the center line in the longitudinal direction, in place of the window hole 24 of the substrate 20 in the embodiment described above. Such a configuration restricts the area of the holes at the opposing positions of the ribbon diaphragm 60, and allows for a design to generate an acoustic resonance, and also allows the frequency characteristics to be extended to a high frequency region. Accordingly, a high-frequency sound wave also can be converted into an electric signal. In the illustrated example, a plurality of circular holes are assumed, but not limited to this form. Such shape, number, size, and position of the window holes of the substrate that generate an acoustic resonance may be employed.

Figure 15:
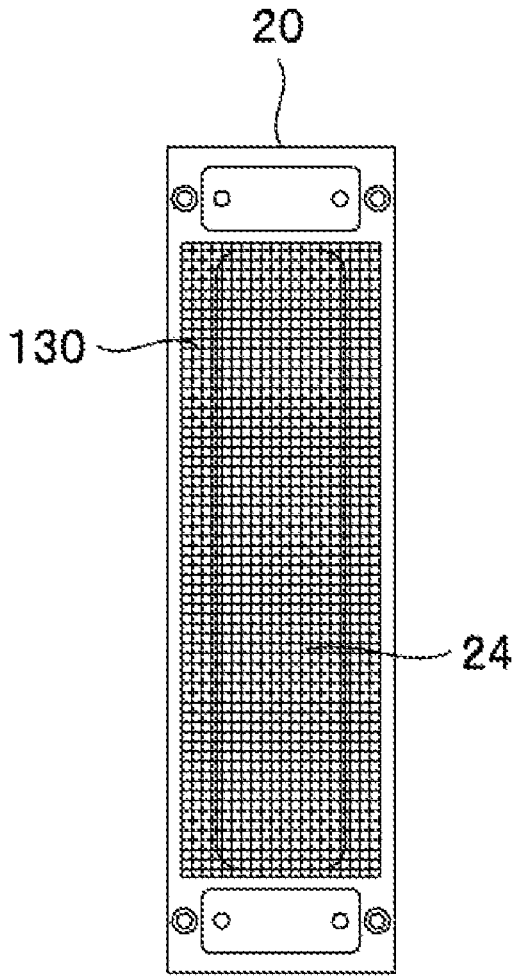
FIG. 15 is a plane view showing another modification of the diaphragm assembly applicable to the present invention.
Figure 16A:
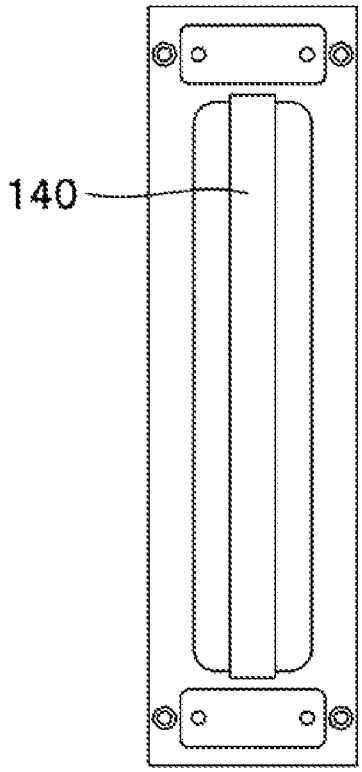
FIG. 16 shows yet another modification of the diaphragm assembly applicable to the present invention, wherein FIG. 16(*a*) is a plane view, and FIG. 16(*b*) is a side view.
Figure 16B:
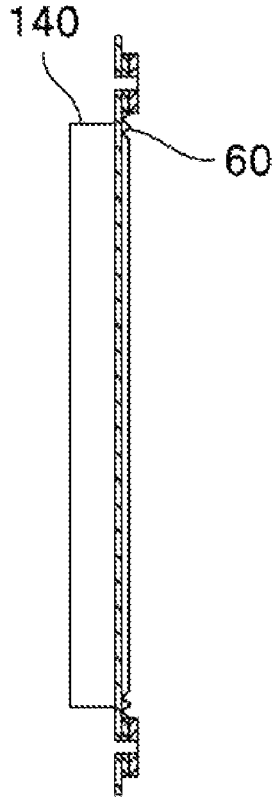

If a magnet made of a neodymium material or the like having a strong magnetic force is used as the magnet 30, a minute iron powder, foreign substance, or the like may adhere thereto and a desired acoustic characteristic as the ribbon microphone may be lost to cause a failure. FIG. 15 and FIG. 16 show examples of implementing countermeasures for avoiding the cause of the above-described failure. In FIG. 15, reference numeral 130 denotes a dustproof cloth. As illustrated, the mesh dustproof cloth 130 may be attached to the position to plug the window hole 24 of the substrate 20.

An example shown in FIG. 16 shows an example using an iron powder adsorbing magnet as the dust protection. As illustrated, an iron powder adsorbing magnet 140 having a slender rectangular column shape is fixedly adhered to the position to plug the window hole 24, from the back side of the surface, in which the ribbon diaphragm 60 is provided in a tensioned manner, of the substrate 20. The iron powder adsorbing magnet 140 is assumed to have a weak magnetic force relative to the magnet 30 of the magnetic-circuit assembly 90, and includes opposing poles on both sides in the width direction so as not to change the parallel magnetic field within the magnetic gap as much as possible. The installation of the dustproof cloth 130 and the iron powder adsorbing magnet 140 makes it possible to prevent a minute iron powder or foreign substance from entering the inside of the microphone unit 10 from the outside of the ribbon microphone.

As described above, according to the ribbon microphone unit of the present invention, because the ribbon microphone unit comprises the diaphragm assembly and the magnetic-circuit assembly and each of them has a detachable configuration, the readjustment of the tension or the replacement of the diaphragm assembly or magnetic-circuit assembly can be easily carried out by a user side in maintaining the ribbon diaphragm. Moreover, when two diaphragm assemblies comprising the ribbon diaphragm are used, the sensibility of the microphone can be improved by connecting the respective diaphragm assemblies in series. Furthermore, according to the embodiments of the present invention, by attaching the dustproof cloth, the iron powder adsorbing magnet, or the like to the window hole of the substrate, it is possible to prevent a minute iron powder or foreign substance from entering the inside of the microphone unit.

If the ribbon microphone unit described above is incorporated into the microphone case to configure the ribbon microphone, the ribbon microphone that provides the effects as described above can be obtained.

What is claimed is:

1. A ribbon microphone unit comprising:

a magnetic-circuit assembly; and two ribbon diaphragm assemblies, wherein the magnetic-circuit assembly comprises:

a yoke having a rectangular window hole that is formed in a center, opposing magnets secured to wall surfaces in the longitudinal direction of the rectangular window hole, and a magnetic gap formed between the magnets;

wherein each of the two ribbon diaphragm assemblies comprises:

a ribbon diaphragm disposed inside the magnetic gap and vibrates in response to a sound wave; and a substrate having a window hole and a circuit pattern formed on both ends of the window hole;

wherein the two ribbon diaphragm assemblies are respectively attachable to and detachable from both side of the magnetic-circuit assembly.

2. The ribbon microphone unit according to claim 1, wherein a spacer is interposed between the circuit pattern and the ribbon diaphragm.

3. The ribbon microphone unit according to claim 2, wherein the ribbon diaphragm is lifted from a surface of the substrate by the spacer being interposed between the circuit pattern and the ribbon diaphragm.

4. The ribbon microphone unit according to claim 1, wherein:

the substrate is rectangular, and has a window hole with a length approximately equal to or greater than half a length of the substrate, the length of the window hole extends in a longitudinal direction, and the window hole is formed in a center of the substrate.

5. The ribbon microphone unit according to claim 1, wherein the metal fitting is made of an electrically conductive material.

6. The ribbon microphone unit according to claim 1, wherein the yoke is rectangular, and has a long window hole, which is long in a longitudinal direction, formed in a center of the yoke.

7. The ribbon microphone unit according to claim 1, wherein the magnet is fixedly adhered to an inner wall parallel to a longitudinal direction of the window hole of the yoke.

8. The ribbon microphone unit according to claim 1, wherein a dustproof cloth is stuck on a position to plug the window hole of the substrate.

9. The ribbon microphone unit according to claim 1, wherein a magnet is fixedly adhered to a position to plug the window hole of the substrate.

10. A ribbon microphone, wherein the ribbon microphone unit according to any of claims 1 to 3, 4 to 7, 8, and 9 is incorporated into a microphone case.

11. The ribbon microphone unit according to claim 1, wherein the substrate is an integral element with the window hole being a single hole positioned in a center of the substrate.

12. The ribbon microphone unit according to claim 1, wherein the substrate is a rectangular element formed with the window hole being positioned in a longitudinal direction such that the ribbon diaphragm is disposed vertically across the window hole.

13. A ribbon microphone unit comprising:

a magnetic-circuit assembly including a magnet and having a magnetic gap; and a ribbon diaphragm disposed inside the magnetic gap and vibrates in response to a sound wave, wherein the magnetic-circuit assembly comprises a yoke having a window hole and a magnet secured to a wall surface of the window hole, wherein the ribbon diaphragm, together with a substrate having a window hole and a circuit pattern formed on both ends of the window hole, a metal fitting for crimping an end portion of the ribbon diaphragm to the circuit pattern, and a screw for crimping the metal fitting toward the substrate, constitute the ribbon diaphragm assembly, wherein the ribbon diaphragm assembly is secured to the magnetic-circuit assembly, and wherein the substrate is a rectangular element formed with the window hole being positioned in a longitudinal direction such that the ribbon diaphragm is disposed vertically across the window hole.

14. A ribbon microphone unit comprising:

a magnetic-circuit assembly including a magnet and having a magnetic gap; and a ribbon diaphragm disposed inside the magnetic gap and which vibrates in response to a sound wave, wherein the magnetic-circuit assembly comprises a yoke having a window hole and a magnet secured to a wall surface of the window hole, wherein the ribbon diaphragm, together with a substrate having a plurality of holes being positioned in a longitudinal direction and a circuit pattern formed on both ends of the plurality holes, a metal fitting for crimping an end portion of the ribbon diaphragm to the circuit pattern, and a screw for crimping the metal fitting toward the substrate, constitute the ribbon diaphragm assembly, wherein the ribbon diaphragm assembly is secured to the magnetic-circuit assembly, and wherein a width of the ribbon diaphragm is smaller than a width of each of the plurality of holes.

* * * * *